US007042405B2

(12) United States Patent
Peng

(10) Patent No.: US 7,042,405 B2
(45) Date of Patent: May 9, 2006

(54) PLANAR SATELLITE ANTENNA AND MOBILE ELECTRONIC APPARATUS ARRANGEMENT

(75) Inventor: Juen Tien Peng, Chung Li (TW)

(73) Assignee: Action Electronics Co., Ltd., Chung Li (TW)

( * ) Notice: Subject to any disclaimer, the term of this patent is extended or adjusted under 35 U.S.C. 154(b) by 0 days.

(21) Appl. No.: 10/894,002

(22) Filed: Jul. 20, 2004

(65) Prior Publication Data

US 2006/0017627 A1 Jan. 26, 2006

(51) Int. Cl.
*H01Q 1/24* (2006.01)

(52) U.S. Cl. ..... 343/702; 455/575

(58) Field of Classification Search ..... 343/702, 343/757, 882, 878, 880; 455/90, 575, 562
See application file for complete search history.

(56) References Cited

U.S. PATENT DOCUMENTS

| | | | | |
|---|---|---|---|---|
| 5,867,131 | A * | 2/1999 | Camp et al. | 343/797 |
| 5,949,379 | A * | 9/1999 | Yang | 343/702 |
| 6,067,057 | A * | 5/2000 | Yajima et al. | 343/878 |
| 2005/0024276 | A1 * | 2/2005 | Izumi | 343/702 |

* cited by examiner

*Primary Examiner*—Hoang V. Nguyen
(74) *Attorney, Agent, or Firm*—Rosenberg, Klein & Lee

(57) ABSTRACT

A planar satellite antenna and mobile electronic apparatus arrangement includes a mobile electronic apparatus having a base member and a display panel hinged to the base member, a planar satellite antenna for receiving the satellite signal of an artificial satellite and transmitting the signal to the base member for output through the display panel, and a coupling structure coupled between the display panel and the planar satellite antenna for enabling the planar satellite antenna to be turned upwards, downwards, leftwards, and rightwards relative to the display panel to the best satellite signal receiving position.

5 Claims, 3 Drawing Sheets

PLANAR SATELLITE ANTENNA AND MOBILE ELECTRONIC APPARATUS ARRANGEMENT

BACKGROUND OF THE INVENTION

1. Field of the Invention

The present invention relates to mobile planar satellite antennas and more particularly, to a planar satellite antenna and mobile electronic apparatus arrangement.

2. Description of the Related Art

Following fast development of high technology, a variety of compact and mobile digital electronic apparatus such as mobile personal computers and mobile CD/VCD/DVD players have been developed and have appeared on the market. A mobile CD/VCD/DVD player enables the user to enjoy listening or watching audio/video media stored in a disk when moving outdoors.

Further, people may use a satellite antenna to receive satellite TV programs from an artificial satellite for output through display means. However, conventional satellite antennas are commonly heavy, not highly mobile. It is not convenient to carry a display device with a satellite antenna outdoors.

Therefore, it is desirable to provide a planar satellite antenna and mobile electronic apparatus arrangement that enables the user to enjoy satellite TV programs when moving outdoors.

SUMMARY OF THE INVENTION

The present invention has been accomplished under the circumstances in view. It is one object of the present invention to provide a planar satellite antenna and mobile electronic apparatus arrangement, which has a mobile electronic apparatus equipped with a planar satellite antenna. It is another object of the present invention to provide a planar satellite antenna and mobile electronic apparatus arrangement, which is compact and highly mobile. It is still another object of the present invention to provide a planar satellite antenna and mobile electronic apparatus arrangement, which allows the user to conveniently adjust the planar antenna to the best satellite signal receiving position. It is still another object of the present invention to provide a planar satellite antenna and mobile electronic apparatus arrangement, which enables the user to watch satellite TV programs when moving outdoors.

To achieve these and other objects of the present invention, the planar satellite antenna and mobile electronic apparatus arrangement comprises a mobile electronic apparatus, the mobile electronic apparatus comprising a base member and a display panel hinged to the base member and turnable relative to the base member between a close position and an open position; a planar satellite antenna adapted to receive the satellite signal of an artificial satellite and to transmit the received satellite signal to the mobile electronic apparatus for output through the display panel; and coupling means coupled between the display panel of the mobile electronic apparatus and the planar satellite antenna for enabling the planar satellite antenna to be turned upwards, downwards, leftwards, and rightwards relative to the display panel.

DETAILED DESCRIPTION OF THE PREFERRED EMBODIMENT

Figure 1:
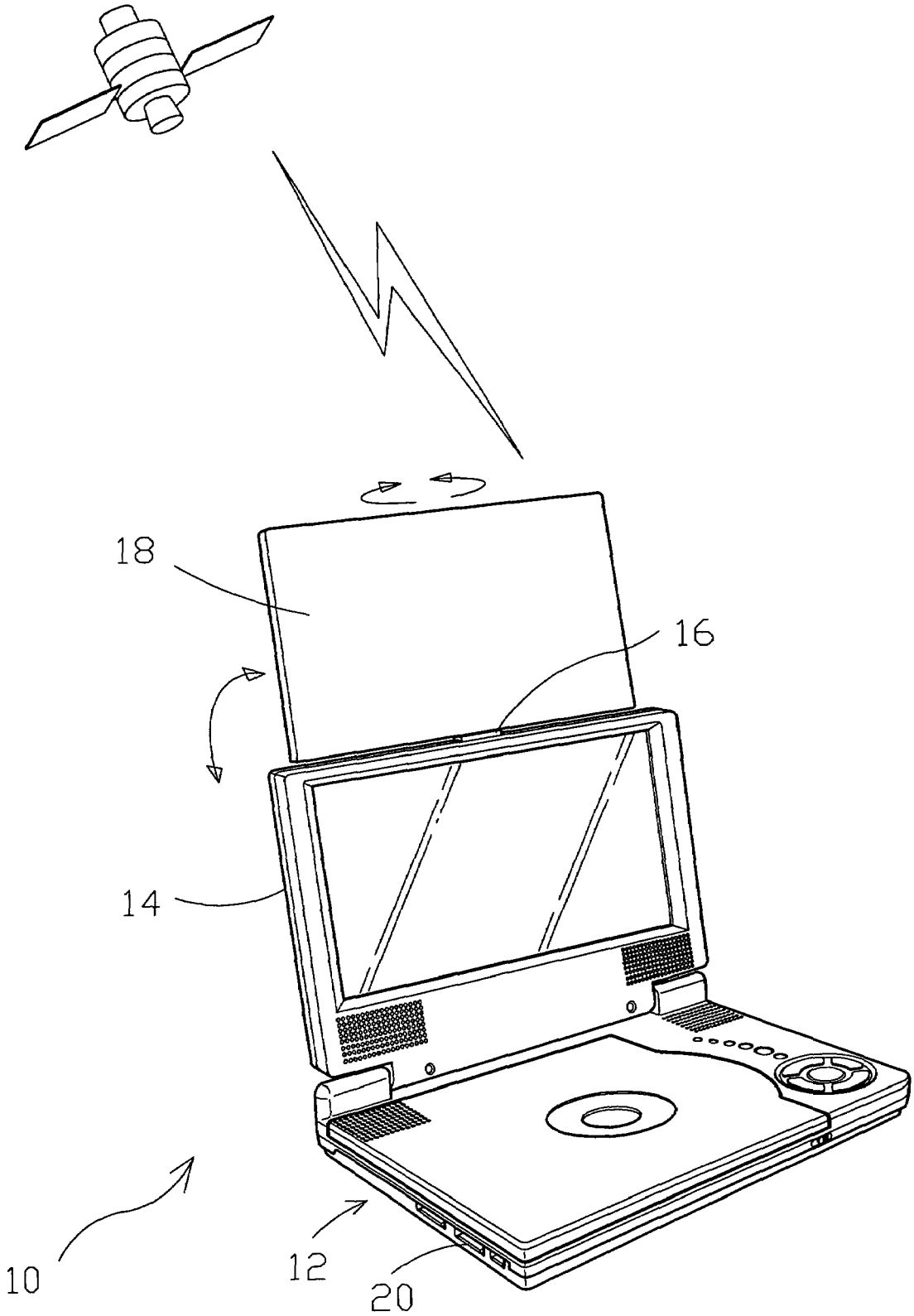
FIG. 1 is an extended view of the preferred embodiment of the present invention.
Figure 2:
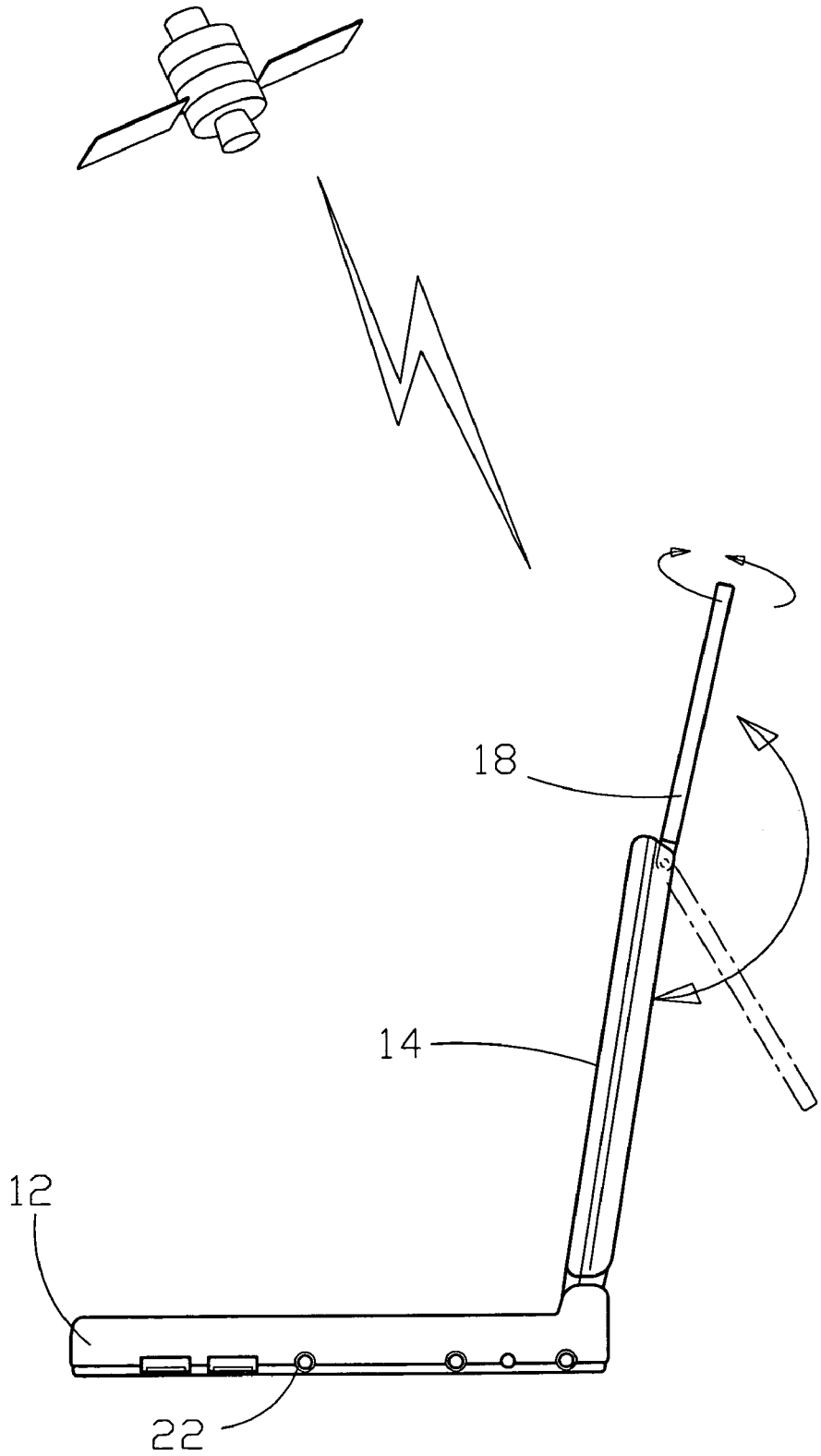
FIG. 2 is a schematic drawing showing a status of use of the preferred embodiment of the present invention.

Referring to FIGS. 1 and 2, a planar satellite antenna and mobile electronic apparatus arrangement in accordance with the present invention is shown comprising a mobile electronic apparatus 10, which comprises a base member 12 and a display panel 14 hinged to the base member 12, a planar satellite antenna 18, and a coupling structure 16 coupled between one side of the planar satellite antenna 18 and one side of the display panel 14 opposite to the base member 12 for enabling the planar satellite antenna to be turned through 180° relative to the display panel 14 between the received position and the extended position and then rotated leftwards or rightwards relative to the display panel 14 to the desired position within 180° in each direction. The mobile electronic apparatus 10 according to the present preferred embodiment can be a notebook computer or CD/VCD/DVD player. The base member 12 of the mobile electronic apparatus 10 has at least one expansion slot 20 and an AV (audio video) signal output port 22. The planar satellite antenna 18 is electrically connected to the base member 12 through a transmission line (not shown) that passes through a hole (not shown) inside the coupling structure 16 for signal output from the planar satellite antenna 18.

Figure 3:
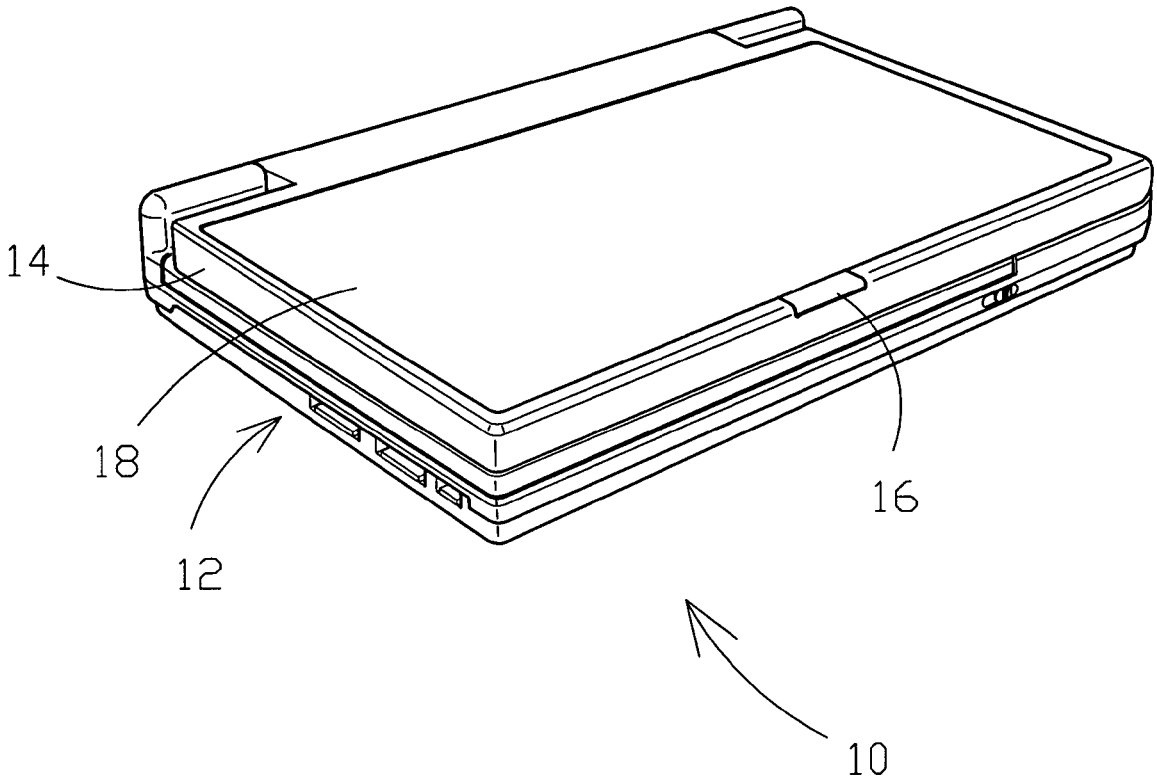
FIG. 3 illustrates the received status of the preferred embodiment of the present invention.

Referring to FIG. 3 and FIGS. 1 and 2 again, when not in use, the planar satellite antenna 18 is closely attached to the back side of the display panel 14 and closed with the display panel 14 on the base member 12 of the mobile electronic apparatus 10 (see FIG. 3). Thus, the user can carry the mobile electronic apparatus 10 by hand to any place. When in use, the display panel 14 is opened from the base member 12, and then the planar satellite antenna 18 is turned upwards from the back side of the display panel 14 through 180° from the received position to the extended position and then rotated horizontally relative to the display panel 14 to the desired angle. Therefore, the planar satellite antenna 18 can be conveniently adjusted to the best position to receive the satellite signal of the assigned artificial satellite, enabling the received satellite signal to be transmitted to the base member 12 for output through the display panel 14.

As indicated above, the invention provides a planar satellite antenna and mobile electronic apparatus arrangement, which enables the user to watch satellite TV programs at any place. Because the mobile electronic apparatus has a display panel and is equipped with a planar satellite antenna, the user can carry the mobile electronic apparatus to any place and enjoy watching satellite TV programs outdoors.

A prototype of planar satellite antenna and mobile electronic apparatus arrangement has been constructed with the features of FIGS. 1–3. The planar satellite antenna and mobile electronic apparatus arrangement functions smoothly to provide all of the features discussed earlier.

Although a particular embodiment of the invention has been described in detail for purposes of illustration, various modifications and enhancements may be made without departing from the spirit and scope of the invention.

What the invention claimed is:

1. A planar satellite antenna and mobile electronic apparatus arrangement comprising:

a mobile electronic apparatus, said mobile electronic apparatus comprising a base member and a display panel hinged to said base member and rotatable relative to said base member between a closed position and an open position;

a planar satellite antenna adapted to receive a satellite signal of an artificial satellite and to transmit the received satellite signal to said mobile electronic apparatus for output through said display panel; and coupling means coupled between said display panel of said mobile electronic apparatus and said planar satellite antenna for enabling said planar satellite antenna to be pivoted upwards relative to said display panel for use and downwards to a storage position wherein a face of said planar satellite antenna is flush with a perimeter portion of a rear side of said display panel, said coupling means enabling rotative displacement of said planar satellite antenna leftwards through 180 degrees relative to said display panel and rightwards through 180 degrees relative to said display panel.

2. The planar satellite antenna and mobile electronic apparatus arrangement as claimed in claim 1, wherein said mobile electronic apparatus is a notebook computer.

3. The planar satellite antenna and mobile electronic apparatus arrangement as claimed in claim 1, wherein said electronic apparatus is a CD/VCD/DVD player.

4. The planar satellite antenna and mobile electronic apparatus arrangement as claimed in claim 1, wherein said base member of said mobile electronic apparatus has at least one expansion slot.

5. The planar satellite antenna and mobile electronic apparatus arrangement as claimed in claim 1, wherein said base member of said mobile electronic apparatus has at least one audio video signal output port.

* * * * *